US008424227B2

(12) United States Patent
Harrington

(10) Patent No.: US 8,424,227 B2
(45) Date of Patent: Apr. 23, 2013

(54) IRON WITH DUAL STEAM CHAMBERS

(75) Inventor: John Harrington, Deerfield Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 98 days.

(21) Appl. No.: 13/192,039

(22) Filed: Jul. 27, 2011

(65) Prior Publication Data

US 2012/0023789 A1 Feb. 2, 2012

Related U.S. Application Data

(60) Provisional application No. 61/369,191, filed on Jul. 30, 2010.

(51) Int. Cl.
*D06F 75/24* (2006.01)
*D06F 75/28* (2006.01)

(52) U.S. Cl.
USPC ..... 38/77.8; 38/77.83; 38/77.9; 38/81

(58) Field of Classification Search ..... 219/259; 68/222; 38/81, 88, 93, 96, 97
See application file for complete search history.

(56) References Cited

U.S. PATENT DOCUMENTS

| | | | | |
|---|---|---|---|---|
| 1,840,652 | A * | 1/1932 | Bell | 219/252 |
| 2,713,225 | A * | 7/1955 | Wolcott | 38/99 |
| 2,970,394 | A * | 2/1961 | Brumbaugh | 38/77.9 |
| 6,953,912 | B2 * | 10/2005 | Alday Lesaga | 219/251 |
| 7,389,597 | B1 * | 6/2008 | Chen | 38/77.83 |
| 7,490,422 | B1 * | 2/2009 | Chen | 38/75 |
| 7,516,565 | B1 * | 4/2009 | Tsen | 38/77.1 |
| 8,276,297 | B2 * | 10/2012 | Fabrikant | 38/15 |
| 2006/0213092 | A1 * | 9/2006 | Di Leta | 38/77.1 |

* cited by examiner

*Primary Examiner* — Ismael Izaguirre
(74) *Attorney, Agent, or Firm* — Michael J. Corrigan

(57) ABSTRACT

A convertible appliance and related method for treating a garment. The appliance includes a housing, a water tank disposed in the housing, a soleplate removably attached to the housing, a first steam chamber configured to generate and emit steam from the soleplate in a first configuration when the soleplate is attached to the housing, a second steam chamber configured to generate and emit steam from the housing in a second configuration when the soleplate is removed from the housing, a valve arrangement configured to fluidly connect the water tank to the first steam chamber when in the first configuration, and alternately, fluidly connect the water tank to the second chamber when in the second configuration.

25 Claims, 3 Drawing Sheets

IRON WITH DUAL STEAM CHAMBERS

This is a non-provisional patent application which claims the benefit of priority to U.S. provisional patent application no. 61/369,191 filed on Jul. 30, 2010.

FIELD OF THE INVENTION

The invention relates to an iron, and more particularly, to an improved convertible iron that includes a diverter valve for diverting water to a first steam chamber for delivering steam to a detachable soleplate when the soleplate is attached, and alternately, to a second steam chamber for delivering steam to the housing when the soleplate is detached.

BACKGROUND OF THE INVENTION

There is a great need for portable, efficient devices to steam and iron garments. It is well-known to use a steaming iron when ironing clothes and other garments. Non-iron devices called "steamers" have also been used to remove wrinkles and creases from clothes on a hanger or hanging from a rack by jetting steam to the clothes. These steamers do not have an ironing function because they lack the hot pressing plate found on irons. Both steam irons and steamers have been used for applying steam to remove creases and crinkles from hanging garments and other cloth materials. Steam has also been used in the cleaning of a variety of objects such as curtains, couches, furniture covers (e.g., couch covers), etc.

While steamers and steaming irons have been useful steam devices, neither device by itself is versatile enough for various applications which require the use of both devices. For example, a steaming iron can be heavy and bulky to use when steaming curtains and other hanging objects such as a wrinkled suit jacket. The steamer is generally lighter and easier to manipulate for steaming, hanging clothing, and other cloth objects.

Accordingly, there is a need for a device that can both iron and steam garments in a conventional manner and still not be too heavy or bulky for steaming hanging garments.

SUMMARY OF THE INVENTION

In an embodiment, there is provided a convertible appliance for treating a garment which includes a housing, a water tank disposed in the housing, a soleplate removably attached to the housing, a first steam chamber configured to generate and emit steam from the soleplate in a first configuration when the soleplate is attached to the housing, a second steam chamber configured to generate and emit steam from the housing in a second configuration when the soleplate is removed from the housing, and a valve arrangement configured to fluidly connect the water tank to the first steam chamber when in the first configuration, and alternately, fluidly connect the water tank to the second chamber when in the second configuration.

In an embodiment, there is provided a method of treating a garment using a convertible appliance, including providing a housing, providing a water tank disposed in the housing, providing a soleplate removably attached to the housing, generating steam with a first steam chamber and emitting the steam from the soleplate in a first configuration when the soleplate is attached to the housing to remove wrinkles from the garment, detaching the soleplate from the housing, generating steam with a second steam chamber and emitting the steam from the housing in a second configuration when the soleplate is removed from the housing to remove wrinkles from the garment.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

A convertible pressing/steaming device that can be converted from a first configuration for conventional pressing/steaming to a second configuration for non-conventional steaming of hanging garments and fabrics is described below.

Figure 1:
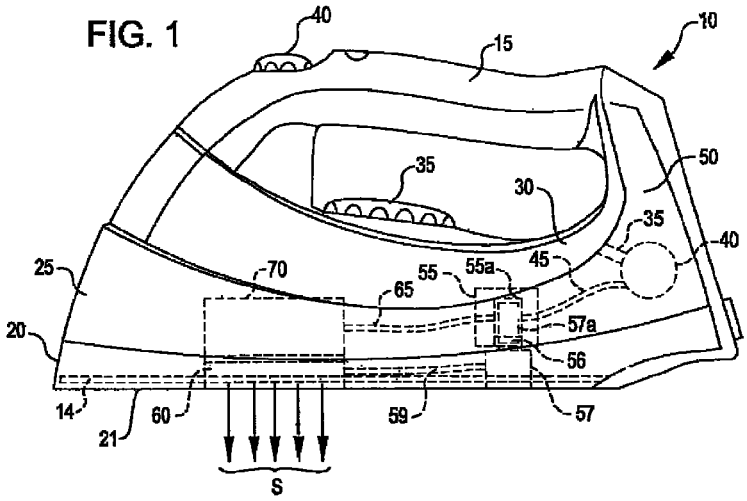
FIG. 1 is a side view of an iron in a first configuration, according to an exemplary embodiment of the invention.
Figure 2:
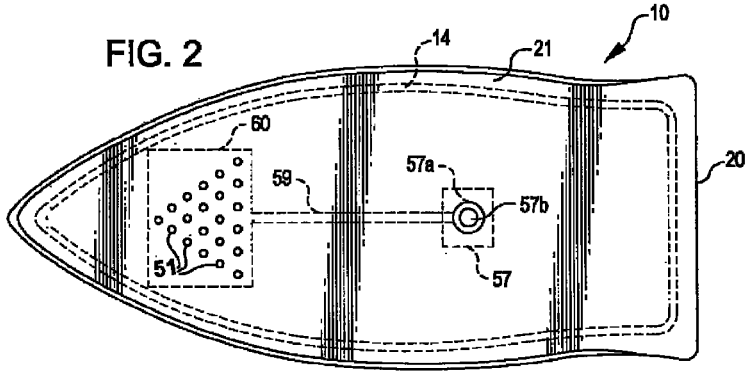
FIG. 2 is a bottom view of the iron of FIG. 1 in a second configuration.

Referring now to the drawing figures in which like reference designators refer to like elements, there is shown in FIGS. 1 and 2 a convertible iron 10 in a first or fully assembled configuration. The iron 10 includes a soleplate 20 made of, for example, a metal material and having a heating element 14 (shown in phantom) mounted in a good heat conducting relationship therewith. Soleplate 20 has, for example, a bottom face or pressing surface 21 adapted to be placed in contact with a suitable fabric to be ironed.

A skirt 25 is mounted on the soleplate 20, followed by a water tank 30 mounted on top of the skirt 25 and secured to the skirt 25 by the use of, for example, screws, flanges, or any other conventional means for fastening. A water tank cover (not shown) may be interposed between the skirt 25 and the water tank 30. The water tank 30 is disposed in a housing 50, for example, in surrounding relation to the aforementioned elements. The housing 50 may be made from plastic or any other suitable material. A similar iron having the foregoing water tank 30 disposed in a housing is illustrated and described in U.S. Pat. No. 6,321,472, owned by a common assignee, and incorporated by reference herein in its entirety.

The water tank 30 includes a cavity (not shown) which may be filled with an aqueous solution such as water. A temperature dial 35 is disposed, for example, beneath a handle 15 formed in an upper portion of the housing 50 and a steam pushbutton 40 is fit, for example, on an upper portion of the housing 50, near the handle portion 15.

In a first configuration, the soleplate 20 is removably attached to the bottom of the skirt 25. Water contained in the tank 30 may be delivered to the soleplate 20 via a first steam chamber 60, for example in response to activation of the steam pushbutton 40 disposed in the handle 15, where it is emitted as steam S from openings 51 (FIG. 2) in the front portion of the soleplate 20 in a well-known manner. The water is delivered to the first steam chamber 60 from the tank 30 by a pump 40. A conduit 35 fluidly connects the water tank 30 to the pump 40. Another conduit 45 fluidly connects the pump 40 to a diverter valve assembly 55. The diverter valve assembly 55 is fluidly connected to a connector block assembly 57 disposed in the soleplate 20 via a nipple 57*a* extending from the connector block assembly 57 that fits into a socket 55*a* of the diverter valve assembly 55. The connector block assembly 57 is fluidly connected to the first steam chamber 60 via a conduit 59.

The use of the nipple 57*a* and the socket 55*a* arrangement allows the connector block assembly 57 to be fluidly disconnected from the diverter block assembly 55 when the soleplate 20 is removed from the bottom of skirt 25 on base 50. The nipple 57*a* has a hollow interior 57*b* which acts as a fluid conduit from within the interior 55*a* of the valve block assembly 55 to connector block assembly 57. The nipple 57*a* has an orifice 57*c* formed through its sidewall (best seen in FIG. 3) where fluid from within the interior 55*a* of the valve block assembly 55 enters the interior 57*b* of the nipple 57*a* when nipple 57*a* is inserted in the socket 55*a* of the valve block assembly 55. A seal 56 seals the socket 55*a* when the nipple 57*a* is removed from the socket 55*a*.

Figure 3:
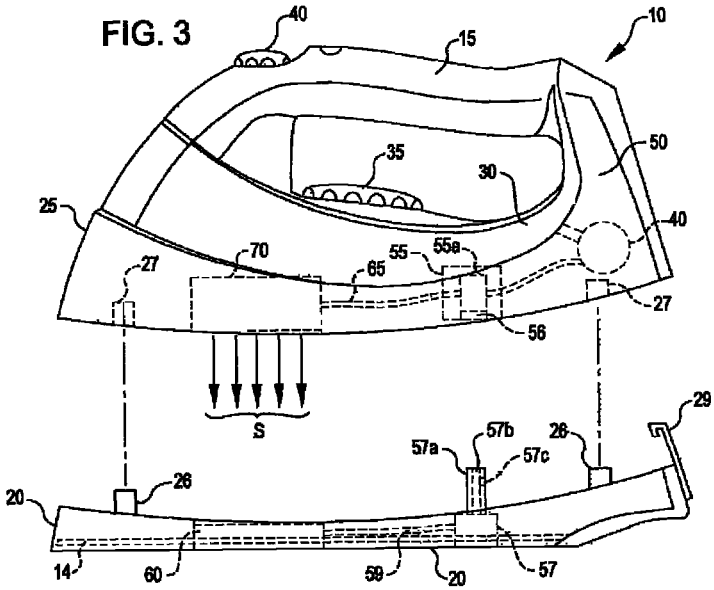
FIG. 3 is a side view of the iron of FIG. 1 with the soleplate detached.
Figure 4:
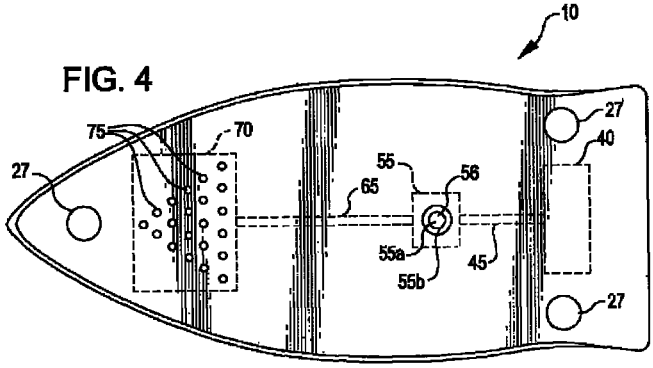
FIG. 4 is a bottom plan view of the iron of FIG. 3 with the soleplate detached.
Figure 5:
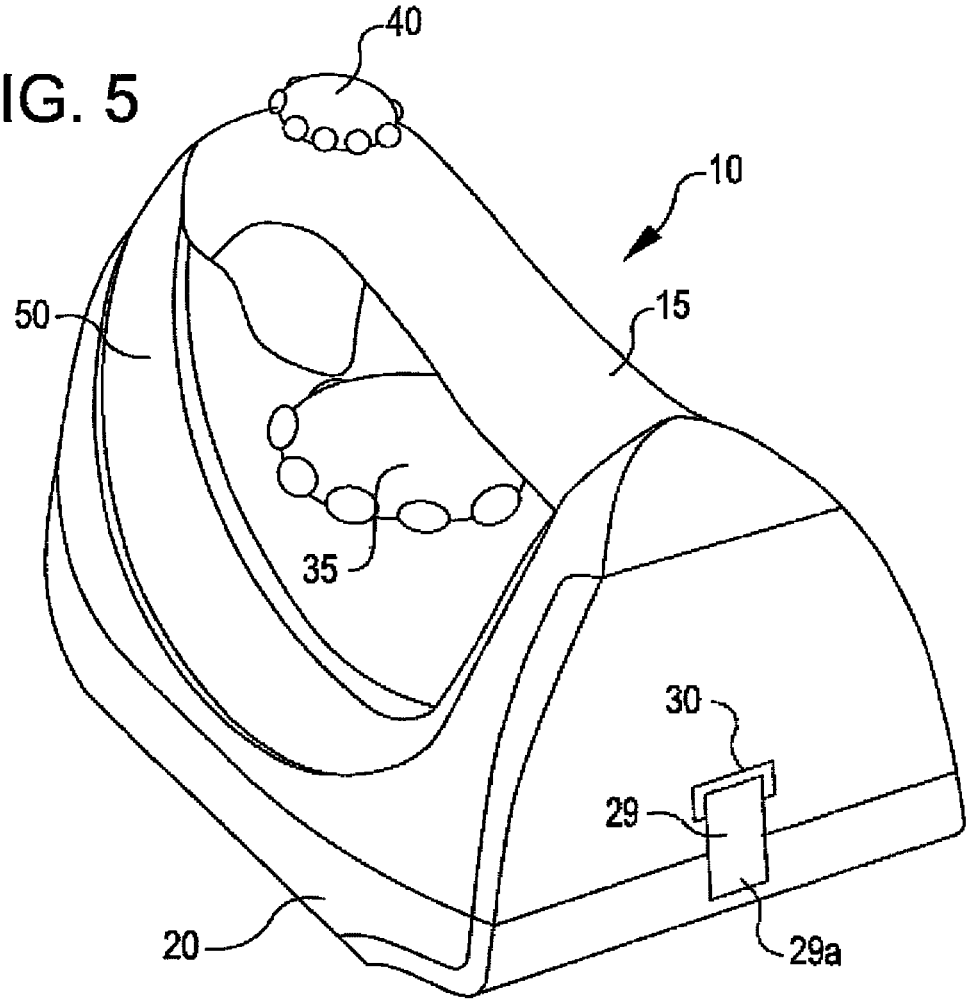
FIG. 5 is a rear perspective view of the iron of FIGS. 1-4.

Referring now to FIGS. 3 and 4, shown is the iron 10 in a second configuration wherein the soleplate 20 is removed from the bottom of skirt 25 allowing the iron 10 to be used as a hand held steamer. The detachment of soleplate 20 from the housing 50 significantly reduces the weight of iron 10 enabling the iron 10 to be used in both a horizontal and vertical orientation for pressing and steaming fabric.

Water contained in the tank 30 may be delivered to a second steam chamber 70, for example in response to activation of a steam pushbutton 40 disposed in the handle 15, where it is emitted as steam S from openings 75 (FIG. 4) in the housing 50 in a well-known manner. The water is delivered to the second steam chamber 70 from the tank 30 by the pump 40. A conduit 35 fluidly connects the water tank 30 to the pump 40 and another conduit 45 fluidly connects the pump 40 to the diverter valve assembly 55 as described above. The diverter valve assembly 55 is fluidly connected to the second steam chamber 70 by a conduit 65.

When the nipple 57*a* is inserted into the socket 55*a* of the diverter valve assembly 55, as described above in the first configuration, the water being pumped by the pump 40 is diverted to the connector block assembly 57 for delivery to the first steam chamber 60. At the same time, the nipple 57*a* prevents water from being directed to the conduit 65 and the second steam chamber 70. However, when nipple 57*a* is removed from the socket 55*a*, the seal 56 seals the socket 55*a* and the water is free to flow to the conduit 65 and the second steam chamber 70.

The soleplate 20 may be secured to the housing 50 using any suitable fastening means such as latches, a catch, lock, interference type fit, etc., which allow these elements to be quickly detached and re-attached as desired. For example, in an embodiment as shown in FIGS. 1-5, a latch 29 may be provided at the rear of the soleplate 20 for locking the soleplate 20 to the housing 50 (best seen in FIG. 5). The latch 29 engages a slot 30 on the rear face of the housing 50 and is released by depressing a tab 29*a*. When the tab 29*a* is depressed, the soleplate 20 may be grasped and pulled away from the skirt 25 and the body 50. However, this is not meant to be limiting as any other means for securing the soleplate 20 to the skirt 25 and the housing 50 may be used known to one of ordinary skill in the art.

At least one post 26 is provided at the front end of the soleplate 20 for engaging a socket 27 in the skirt 25 for aligning the soleplate 20 therewith. At least two posts 26 are provided at the rear of the soleplate 20 for engaging a socket 27 in the skirt 25 for aligning the soleplate 20 therewith. However, this is not meant to be means as any means for aligning soleplate 20 with skirt 25 and base 50 may be used.

In another embodiment, the diverter block assembly 55 and the connector block assembly 57 may be replaced with a manually rotated valve (not shown) for switching the water being supplied from the pump 40 between the first steam chamber 60 and the second steam chamber 70. However, this is not meant to be limiting as any other arrangement for switching the water being supplied from the pump 40 between the first steam chamber 60 and the second steam chamber 70 may be used.

In an embodiment, a power cord (not shown) may be operatively connected to the housing 50 to provide power to the iron 10, and in particular to the heating element 14 for heating the soleplate 20 and a generating the steam S from water supplied from the water tank 30. The temperature dial 35 is used to regulate the amount of electrical power provided from the power cord (not shown) to the heating element 14. The power cord (not shown) may be provided with a conventional plug (not shown) which may be connected to a conventional source of ac power.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A convertible appliance for treating a garment, comprising:

a housing;

a water tank disposed in the housing;

a soleplate removably attached to the housing;

a first steam chamber configured to generate and emit steam from the soleplate in a first configuration when the soleplate is attached to the housing;

a second steam chamber configured to generate and emit steam from the housing in a second configuration when the soleplate is removed from the housing; and a valve arrangement configured to fluidly connect the water tank to the first steam chamber when in the first configuration, and alternately, fluidly connect the water tank to the second chamber when in the second configuration.

2. The appliance of claim 1, the valve arrangement further including a diverter valve assembly and a connector block assembly, wherein when in the first configuration the diverter valve assembly is fluidly connected to the connector block assembly, and when in the second configuration, the diverter valve assembly is fluidly disconnected from the connector block assembly.

3. The appliance of claim 2, further including a water tank and a pump, said pump fluidly connected to the water tank via a first conduit, and the pump is fluidly connected to the diverter valve assembly via a second conduit.

4. The appliance of claim 3, the diverter valve assembly further including a socket.

5. The appliance of claim 4, wherein the socket receives a nipple extending from the connector block assembly when in the first configuration, the nipple including an orifice and a hollow interior which act to divert fluid from the diverter valve assembly to a conduit for further delivering water via a third conduit to the first steam chamber.

6. The appliance of claim 5, wherein the socket includes a seal at an open end where the nipple is inserted, said seal configured to allow entry of the nipple into the socket when in the first configuration, and to allow the nipple to exit the socket when changing the iron to the second configuration and seal fluid within the socket when the nipple is completely removed thereby directing fluid to the second steam chamber via a fourth conduit.

7. The appliance of claim 1, further comprising a plurality of openings in the soleplate and in fluid communication with the first steam chamber, and when in the first configuration said plurality of openings are configured to direct steam vertically from the first steam chamber to a garment positioned adjacent the soleplate, said steam for removing wrinkles from the garment during ironing.

8. The appliance of claim 1, further comprising a plurality of openings in the housing and in fluid communication with the second chamber, and when in the second configuration said plurality of openings are configured to direct steam horizontally from the second chamber to a garment positioned adjacent the housing, said steam for removing wrinkles from the garment.

9. The appliance of claim 1, further including a pump.

10. The appliance of claim 1, further including a heating element for heating the soleplate in the first configuration.

11. The appliance of claim 1, further including a fastening means configured to secure the soleplate to the housing in the first configuration.

12. The appliance of claim 11, the fastening means further including a latch provided at a rear of the soleplate configured to secure the soleplate to the housing.

13. The appliance of claim 12, further including a slot formed in a rear face of the housing which is engaged by the latch when in the first configuration configured to secure the soleplate to the housing.

14. The appliance of claim 11, the fastening means further including one of a catch, lock or interference-type fit configured to secure the soleplate to the housing.

15. The appliance of claim 1, further including at least one post provided in the soleplate configured to engage a socket in the housing for aligning the soleplate with the housing.

16. The appliance of claim 1, wherein the valve assembly is a manually rotatable valve for selectively fluidly connecting the water tank to the first steam chamber in the first configuration, or alternately, fluidly connecting the water tank to the second chamber in the second configuration when the soleplate is removed from the housing.

17. The appliance of claim 1, wherein the appliance is an iron.

18. A method of treating a garment using a convertible appliance, comprising:

providing a housing;

providing a water tank disposed in the housing;

attaching a removable soleplate to the housing;

generating steam with a first steam chamber and emitting the steam from the soleplate in a first configuration when the soleplate is attached to the housing, said steam for removing wrinkles from a garment;

detaching the soleplate from the housing; and generating steam with a second steam chamber and emitting the steam from the housing in a second configuration when the soleplate is removed from the housing, said steam for removing wrinkles from the garment.

19. The method of claim 18, further including:

fluidly connecting with a valve arrangement the water tank to the first steam chamber in the first configuration when the soleplate is attached to the housing.

20. The method of claim 18, further including:

fluidly connecting the water tank to the second chamber in the second configuration when the soleplate is removed from the housing.

21. The method of claim 18, further including:

providing a diverter valve assembly as part of the valve arrangement; and providing a connector block assembly as part of the valve arrangement.

22. The method of claim 21, further including:

fluidly connecting the diverter valve assembly to a connector block assembly when in the first configuration.

23. The method of claim 21, further including:

fluidly disconnecting the diverter valve assembly from the connector block assembly when converting to the second configuration.

24. The method of claim 18, further including:

securing the soleplate to the housing using a fastening means when in the first configuration.

25. The method of claim 18, further including:

removing the soleplate from the housing by operating a fastening means to convert to the second configuration.

* * * * *